US008469207B2

(12) United States Patent
Rowan et al.

(10) Patent No.: US 8,469,207 B2
(45) Date of Patent: Jun. 25, 2013

(54) DRAPERY ROD ASSEMBLY

(75) Inventors: Paul Rowan, Toronto (CA); Mauricio Affonso, Toronto (CA)

(73) Assignee: Umbra LLC, Buffalo, NY (US)

( * ) Notice: Subject to any disclaimer, the term of this patent is extended or adjusted under 35 U.S.C. 154(b) by 351 days.

(21) Appl. No.: 12/846,523

(22) Filed: Jul. 29, 2010

(65) Prior Publication Data

US 2012/0024809 A1 Feb. 2, 2012

(51) Int. Cl.

| | |
|---|---|
| ***A47H 13/00*** | (2006.01) |
| *A47H 1/02* | (2006.01) |
| *A47H 1/14* | (2006.01) |
| *A47H 1/10* | (2006.01) |
| *A47H 1/00* | (2006.01) |
| *A47H 1/04* | (2006.01) |

(52) U.S. Cl.

USPC ..... 211/124; 211/105.1; 248/254; 248/262; 160/123; 160/330; 16/94 R

(58) Field of Classification Search

USPC ..... 211/105.1–105.6, 206, 123, 124; 248/222.14, 251, 254, 262, 267; 160/330, 160/123, 124; 16/94 R

See application file for complete search history.

(56) References Cited

U.S. PATENT DOCUMENTS

| | | | | | |
|---|---|---|---|---|---|
| 786,030 | A | * | 3/1905 | Haygood | 238/216 |
| 932,684 | A | * | 8/1909 | Depp | 248/254 |
| 1,201,834 | A | * | 10/1916 | Laun | 211/105.2 |
| 1,361,058 | A | * | 12/1920 | Hills | 211/105.2 |
| D60,046 | S | | 12/1921 | Lojewski | |
| 1,406,311 | A | * | 2/1922 | Wendel | 211/105.2 |
| 1,424,337 | A | * | 8/1922 | Boye | 211/105.2 |
| 1,453,748 | A | * | 5/1923 | Carlson | 211/105.2 |
| 1,458,232 | A | * | 6/1923 | Maienschein | 248/254 |
| 1,482,334 | A | * | 1/1924 | Wolff | 248/262 |
| 1,504,825 | A | * | 8/1924 | Larsen | 211/105.2 |
| 1,559,895 | A | * | 11/1925 | Larsen | 160/112 |
| 1,576,764 | A | * | 3/1926 | Kenney | 211/105.2 |
| 2,012,482 | A | * | 8/1935 | Russell | 248/254 |
| 2,492,517 | A | * | 12/1949 | Bernick | 211/123 |
| 2,727,272 | A | * | 12/1955 | Hankin et al. | 16/93 D |
| 3,157,225 | A | * | 11/1964 | Freydberg et al. | 160/345 |
| 4,068,345 | A | * | 1/1978 | Hehl et al. | 16/94 D |
| 4,140,294 | A | * | 2/1979 | Zwarts | 248/265 |
| 4,179,091 | A | * | 12/1979 | Bidney | 248/265 |

(Continued)

FOREIGN PATENT DOCUMENTS

WO WO 2009129565 A1 * 10/2009

*Primary Examiner* — Joshua J Michener
*Assistant Examiner* — Devin Barnett
(74) *Attorney, Agent, or Firm* — Simpsons & Simpson, PLLC

(57) ABSTRACT

A drapery rod assembly adapted to be secured to a substantially planar surface comprising a right bracket and a left bracket. The right bracket includes a substantially gamma shaped wall portion having a slot, a mounting plate that is operatively arranged to be mounted to the surface. The mounting plate is operatively arranged to complementarily engage the slot and hold the wall portion. A substantially J-shaped extension portion that extends outward from the wall portion and terminates in a rod attachment end arranged perpendicularly with respect to the mounting plate and in parallel spaced apart relation to the surface. The left bracket is an enantiomer of the right bracket. A first and second rod, each rod includes a proximate and distal end. The distal end of the first rod is releasably engaged with the left bracket, and the distal end of the second rod is releasably engaged with the right bracket.

14 Claims, 10 Drawing Sheets

U.S. PATENT DOCUMENTS 5,310,148 A * 5/1994 Dorr ..... 248/223.41
5,318,174 A * 6/1994 Zoroufy ..... 211/45
5,678,703 A * 10/1997 Sawyer ..... 211/105.1
5,690,237 A * 11/1997 Marzec ..... 211/105.1
5,875,903 A * 3/1999 Chen ..... 211/105.1
6,598,843 B1 * 7/2003 Bell et al. ..... 248/261
6,719,156 B2 * 4/2004 Ellbogen et al. ..... 211/105.1
7,100,661 B1 * 9/2006 Pittman ..... 160/38
7,111,336 B1 * 9/2006 Lai ..... 4/576.1
D644,918 S * 9/2011 Rowan et al. ..... D8/363
D656,005 S * 3/2012 Affonso ..... D8/380
8,231,093 B2 * 7/2012 Tran ..... 248/262
8,297,576 B2 10/2012 McLeod
2002/0088764 A1 * 7/2002 Pan ..... 211/105.1
2007/0170134 A1 * 7/2007 Bishop et al. ..... 211/105.1
2009/0308995 A1 * 12/2009 Kuo ..... 248/231.91

* cited by examiner

DRAPERY ROD ASSEMBLY

FIELD OF THE INVENTION

The present invention generally relates to window drapery hardware. More specifically, the present invention relates to drapery rod assemblies.

BACKGROUND OF THE INVENTION

Contemporary drapery rod assemblies are functional in that they enable a set of curtains or draperies hanging upon the assembly to be supported over a window. The rod assembly permits the curtains or draperies to be drawn open or closed. Conventional drapery hardware includes a pair of end brackets that are attached to a window frame or wall by means of nails or screws and a rod or a plurality of rods suspended from the pair of brackets. While drapery rod assemblies are obviously functional, such assemblies and the mounting hardware used to support the assemblies generally are not aesthetically pleasing and are not hidden from view.

Another problem with these previous rod assemblies is the difficulty of positioning and mounting the assembly uniformly on a wall. The task is quite time consuming and requires a certain level of skill to install the assembly correctly. The process of holding an end bracket against the wall and driving a screw through a mounting opening can be difficult because the configuration of previous end brackets prevents a securing tool from having a clear path to the mounting openings. This configuration causes the supporting hardware to be installed at an angle thus reducing its supporting strength. Thus, there is a long-felt need for a drapery rod assembly that includes a support bracket that positions virtually all of the mounting hardware and mounting screws behind the surface of the bracket and thus hidden from view. There is a further long-felt need for a drapery rod assembly that is simple to install onto a window frame or wall. There is a further long-felt need for a drapery rod assembly that enables draperies to hang upon the assembly, with a portion of the drapery wrapped about a pair of end brackets and retained to the brackets, virtually concealing all of the drapery rod assembly behind the fabric of the drapes and thus hidden from view.

BRIEF SUMMARY OF THE INVENTION

The present invention broadly comprises a drapery rod assembly adapted to be secured to a substantially planar surface including a left bracket comprised of a mounting plate, which is operatively arranged to be mounted to the substantially planar surface. A wall portion comprised of a first segment having a slot, and a second segment, which is in communication with and extends from the first segment. The mounting plate is operatively arranged to complementarily engage the slot and hold the first segment. An extension portion includes a third segment and a fourth segment. The third segment is in communication with and extends from the second segment. The fourth segment is arranged perpendicularly with respect to the mounting plate and in parallel spaced apart relation to the substantially planar surface. The bracket slidingly engages the mounting plate in a manner that positions substantially all of the mounting plate and the securing hardware behind the surface of the bracket and thus hidden from view.

In some embodiments, the assembly further includes a right bracket comprising an enantiomer of the left bracket.

In some embodiments, the mounting plate has a first cross-section, and the slot has a second cross-section, in which the shape of the first cross-section is complementary with the second cross-section. In some embodiments, the first cross-section and the second cross-section are trapezoidal in shape.

In some embodiments, the first segment has a back surface, and the second segment has a recessed surface. The back surface and the recessed surface are non-coplanar. In some embodiments, a recess is formed between the recessed surface of the first segment and a plane of the planar surface. In some embodiments, the recess has a first height to the plane of the planar surface. The first segment may include a retaining member having a second height less than the first height. In some embodiments, the retainer member is comprised of an elastomeric material.

The present invention also broadly comprises a drapery rod assembly adapted to be secured to a substantially planar surface comprising a right bracket and a left bracket. The right bracket includes a substantially gamma shaped wall portion having a slot, a mounting plate that is operatively arranged to be mounted to the substantially planar surface. The mounting plate is operatively arranged to complementarily engage the slot and hold the wall portion. A substantially J-shaped extension portion that extends outward from the wall portion and terminates in a rod attachment end arranged perpendicularly with respect to the mounting plate and in parallel spaced apart relation to the substantially planar surface. The left bracket is an enantiomer of the right bracket. At least one rod, in which a first rod and a second rod from the at least one rod comprises a proximate end and a distal end. The distal end of the first rod is releasably engaged with the rod attachment means of the left bracket, and the distal end of the second rod is releasably engaged with the rod attachment means of the right bracket. The proximate end of the first rod is arranged to slidingly engage the proximate end of the second rod.

In some embodiments, the drapery rod assembly includes at least one support bracket. The support bracket includes a third mounting plate, which is operatively arranged to be mounted to the substantially planar surface, a horizontal segment, and a third wall portion having a slot. The third mounting plate is operatively arranged to complementarily engage the slot and hold the third wall portion. The horizontal segment has a rod-receiving portion, which is operatively arranged to support the first rod and the second rod.

The present invention also broadly comprises a drapery rod assembly adapted to be secured to a substantially planar surface including a left bracket comprising a first mounting plate having a first trapezoidal cross-section. The first mounting plate is oriented in a first direction, and operatively arranged to be mounted to the substantially planar surface. A first wall portion includes a first segment having a slot with a second trapezoidal cross-section, and a second segment, which is in communication with and integrally extends from the first segment. The first mounting plate is operatively arranged to complementarily engage the slot of the first segment and hold the first segment. A first extension portion comprising a third segment, and a fourth segment oriented in a second direction. The third segment is in communication with and integrally extends from the second segment. The fourth segment is arranged perpendicularly with respect to the mounting plate and in parallel spaced apart relation to the substantially planar surface. A right bracket includes a second mounting plate having a third trapezoidal cross-section. The second mounting plate is oriented in a first direction, and operatively arranged to be mounted to the substantially planar surface. A second wall portion includes a fifth segment having a slot with a fourth trapezoidal cross-section, and a sixth segment;

the sixth segment is in communication with and extends from the fifth segment. The second mounting plate is operatively arranged to complementarily engage the slot of the fifth segment and hold the fifth segment. A second extension portion includes a seventh segment, and an eighth segment. The seventh segment is in communication with and extends outward from the sixth segment and the eighth segment is arranged perpendicularly with respect to the mounting plate and in parallel spaced apart relation to the substantially planar surface. The eighth segment is oriented opposite the second direction and collinearly aligned with the fourth segment. The assembly further comprises an extension rod having a first open end and a second open end. The first open end is arranged to slidingly engage the proximate end of the first rod, and the second open end is arranged to slidingly engage the proximate end of the second rod.

In some embodiments, the left bracket is an enantiomer of the right bracket.

In some embodiments, the drapery rod assembly includes at least one rod, in which a first rod and a second rod from the at least one rod comprises a proximate end and a distal end. The distal end of the first rod is releasably engaged with the fourth segment, and the distal end of the second rod is releasably engaged with the eighth segment. The proximate end of the first rod is arranged to slidingly engage the proximate end of the second rod.

In some embodiments, the rod assembly includes at least one support bracket having a third mounting plate oriented in a first direction and operatively arranged to be mounted to the substantially planar surface, and a third wall portion having a slot and a horizontal segment. The third mounting plate is operatively arranged to complementarily engage the slot and hold the third wall portion. The horizontal segment includes a rod-receiving portion, which is operatively arranged to engage and support at least one rod.

In some embodiments, the second segment is parallel to the fourth segment, the second segment is orthogonal to the third segment, and the third segment is orthogonal to the fourth segment.

In some embodiments, the sixth segment is parallel to the eighth segment, the sixth segment is orthogonal to the seventh segment, and the seventh segment is orthogonal to the eighth segment. In some embodiments, the fourth segment includes a first protrusion, and the eighth segment includes a second protrusion, in which each said protrusion is externally threaded.

In some embodiments, the distal end of the first rod is threadedly secured to the fourth segment of the left bracket and the distal end of the second rod is threadedly secured to the eighth segment of the right bracket.

In some embodiments, at least one of the mounting plates, the wall portions, and the extension portions is formed from a cast metal.

It is a general object of the present invention to provide a drapery rod assembly that is configured in a manner that positions virtually all of the mounting hardware behind the surface of the rod brackets and are thus completely hidden from view.

It is another general object of the present invention to provide a drapery rod assembly that enables draperies to hang upon the assembly, and a portion of the drapery fabric can be wrapped around a pair of mounted end brackets. The fabric is retained behind the brackets, virtually concealing all of the drapery rod assembly behind the fabric of the drapes and are thus hidden from view.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention.

While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Figure 1:
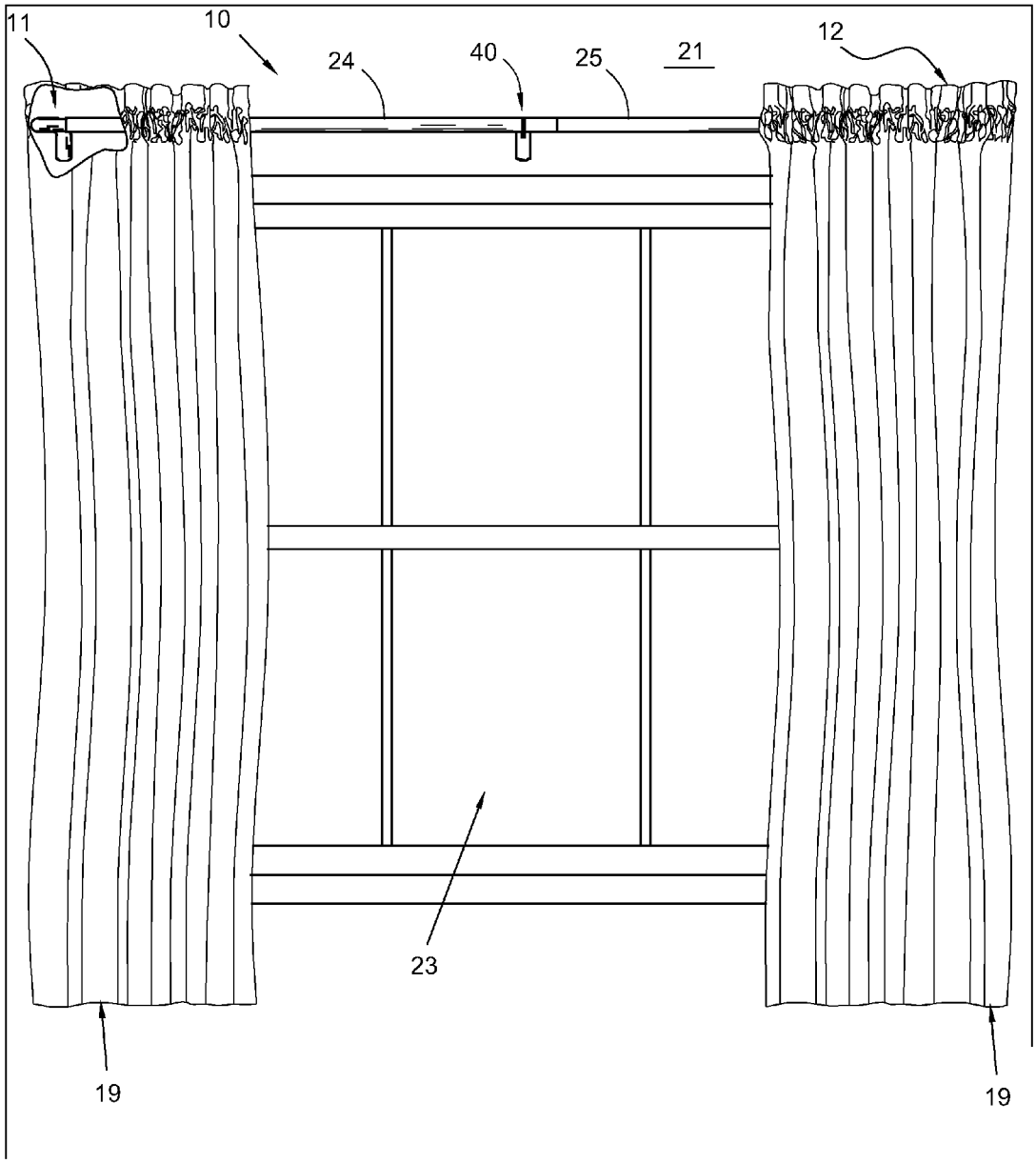
FIG. 1 is a front view of the drapery rod assembly of the present invention illustrating the drapery rod assembly mounted over a window and drapes hanging therefrom.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "curtain" is synonymous with terms such as "drape", "drapery", "swathe", "clothe", "panel", "valance", etc., and such terms may be used interchangeably as appearing in the specification and claims. The term "enantiomer" is defined as one of two objects that are mirror images of each other but the objects are non-superposable or not identical. The terms "left" and "right" respectively, as used to describe the mounting brackets of the present invention, are taken from the perspective of one facing the drapery rod assembly as shown in FIG. 1. Although any methods, devices or materials similar or equivalent to those described herein can be used in the practice or testing of the invention, the preferred methods, devices, and materials are now described.

Adverting now to the figures, FIG. 1 illustrates one embodiment of the present invention showing a front view of rod assembly 10 having left bracket 11 and right bracket 12, which is not shown, but is mounted to wall 21 and hidden from view behind drapes 19, positioned over window 23 and mounted onto wall 21. Drapes 19 are illustrated hanging from first rod 24 and second rod 25, which are supported by support bracket 40.

Figures 2A, 2B:
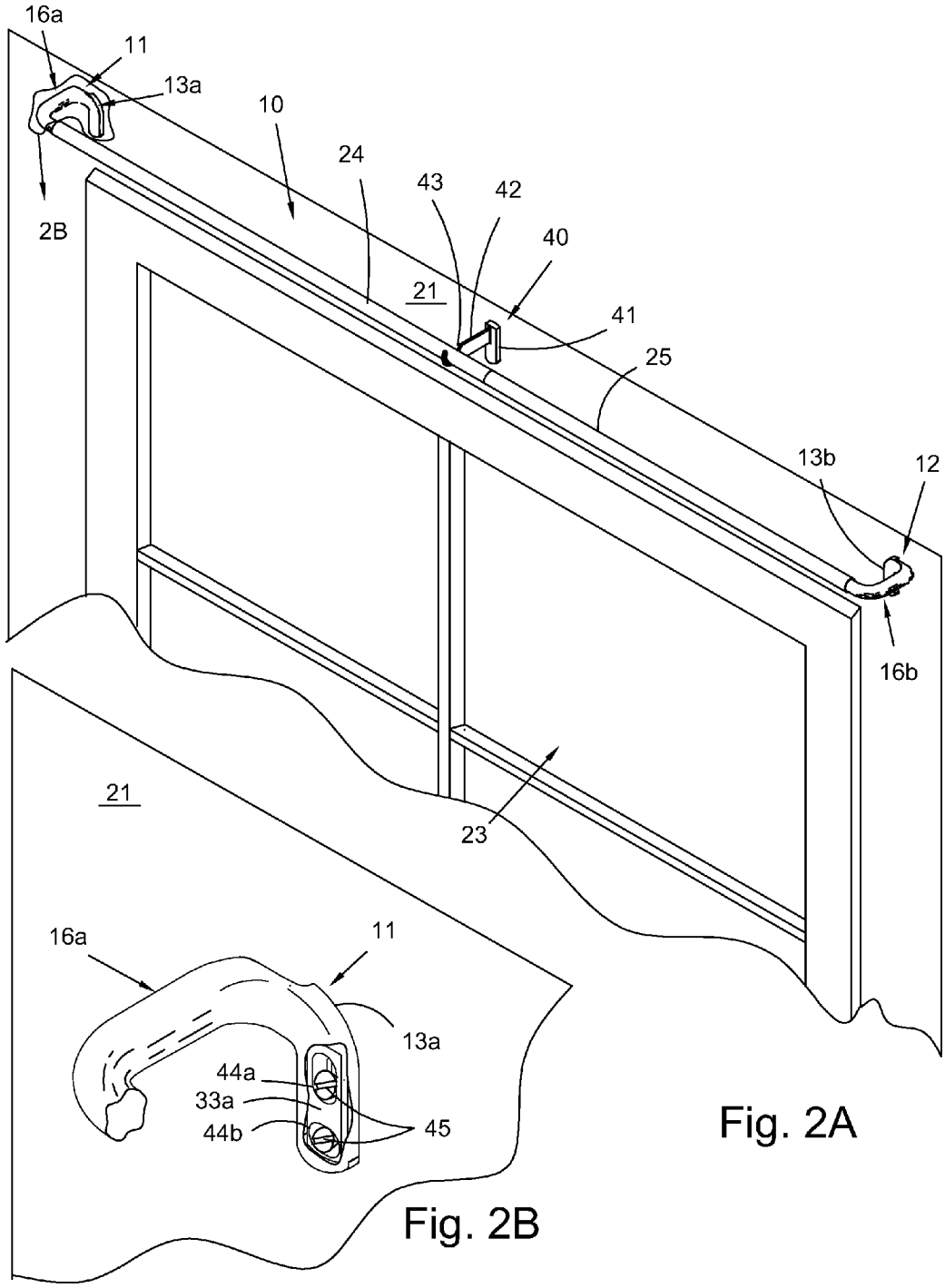
FIG. 2*a* is a front perspective view of the present invention shown in FIG. 1.
FIG. 2*b* is a detailed view of a left bracket of the present invention shown in FIG. 2*a;*

FIG. 2*a* is a front perspective view of an embodiment of the present invention shown in FIG. 1 illustrating drapery rod assembly 10 mounted over window 23. Left bracket 11 includes wall portion 13*a*, which is adapted to matingly engage a planar surface such as wall 21 and extension portion 16*a*, which is removably fastened to first rod 24. Similarly, right bracket 12 includes wall portion 13*b*, which is adapted to matingly engage with a planar surface such as wall 21 and extension portion 16*b*, which is removably fastened to second rod 25. Support bracket 40 includes wall portion 41 that is arranged to matingly engage with a planar surface such as wall 21; and horizontal segment 42 including rod receiving portion 43, which is adapted to releasably secure and support rod 24. Each of the brackets is secured to a surface by means of a mounting plate. Preferably, the left and right brackets and the support bracket are slidingly engaged on a mounting plate in a manner that positions virtually all of the mounting plate and the securing hardware behind the surface of each of the brackets. For example, as illustrated in FIG. 2*b*, mounting plate 33*a* is fixedly secured to wall 21 by mounting screws 45, which pass through mounting apertures 44*a-b*, respectively. Left bracket 11 slidingly engages mounting plate 33*a* in a manner that positions virtually all of the mounting plate, and the securing hardware behind the surface of left bracket 11.

Figure 3:
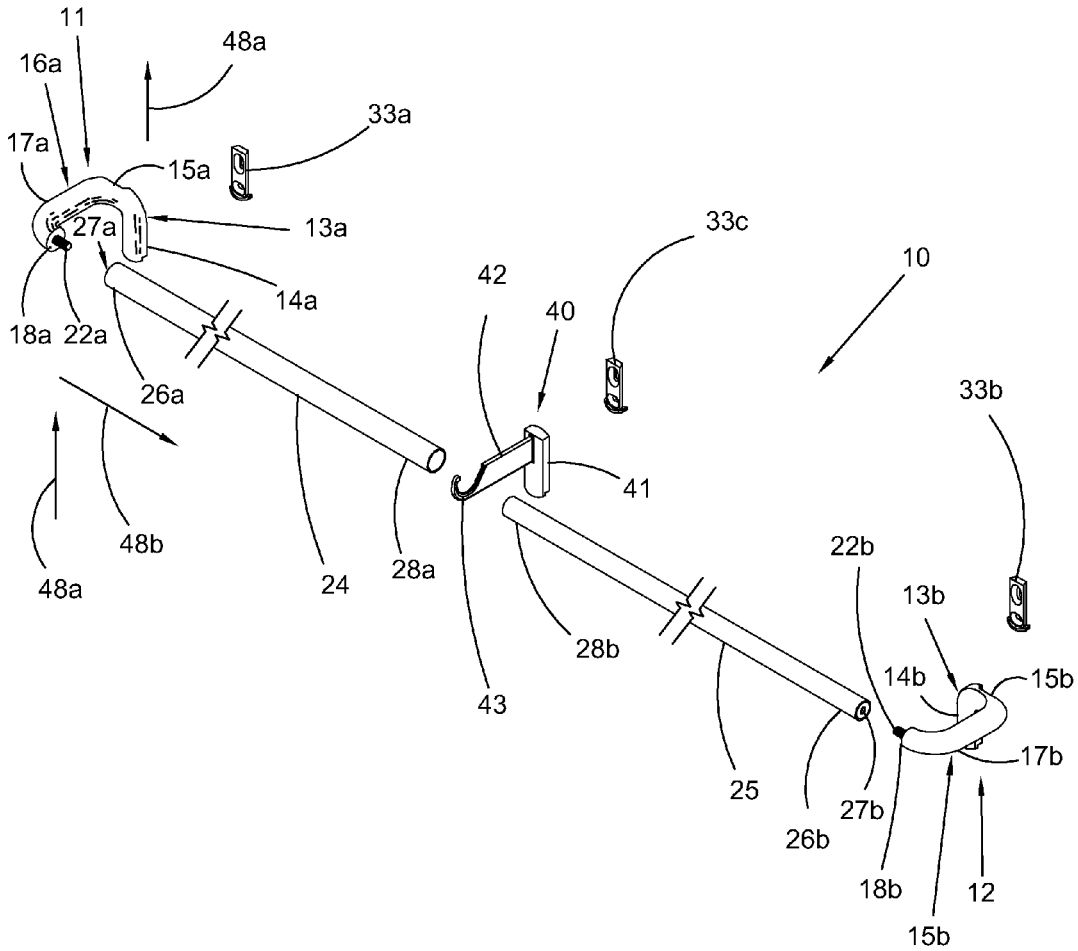
FIG. 3 is an exploded view of the drapery rod assembly shown in FIG. 1.

FIG. 3 is an exploded front perspective view of rod assembly 10 shown in FIGS. 1 and 2. The present invention rod assembly includes left bracket 11 and right bracket 12. Left bracket 11 is seen to comprise wall portion 13*a* including first segment 14*a* and second segment 15*a*. Extension portion 16*a* includes third segment 17*a* and fourth segment 18*a*. Similarly, right bracket 12 is seen to comprise wall portion 13*b* including first segment 14*b* and second segment 15*b*. Extension portion 16*b* includes third segment 17*b* and fourth segment 18*b*.

In general, the left and right brackets are removably fastenable to the respective ends of the rods. By this we mean that the brackets can be secured to the ends of the rods, remain fastened/connected to the rods, but can be removed by applying sufficient force. That is, the brackets and the rods are configured to be assembled and disassembled. In one embodiment, left bracket 11 and right bracket 12 are frictionally fastenable to the rods. By this, we mean that the friction between the brackets and the rods is sufficient to hold the rods in the brackets. In one embodiment, left bracket 11 and right bracket 12 include protrusions 22*a-b* on respective fourth segments 18*a-b* and rods 24 and 25 include openings 27 at respective ends 26*a* and 26*b*. Each protrusions 22*a-b* is engagable with respective opening 27 in a complementary friction fit. That is, openings 27 are arranged to receive protrusions 22*a-b*. Specifically, fourth segment 18*a* of left bracket 11 and fourth segment 18*b* right bracket 12 are releasably engaged to first distal end 26*a* of first rod 24 and second distal end 26*b* of second rod 25, respectively. More specifically, protrusion 22*a* of fourth segment 18*a* is threadedly engaged with opening 27*a* and secured to first distal end 26*a* of first rod 24. Similarly, protrusion 22*b* of fourth segment 18*b* is threadedly engaged with opening 27*b* secured to second distal end 26*b* of second rod 25.

FIG. 3 further illustrates support bracket 40 that includes wall portion 41 and horizontal segment 42 having rod receiving portion 43. Receiving portion 43 is adapted to receive and support first rod 24 and second rod 25. Each bracket includes mounting plate 33*a*, 33*b*, and 33*c*, which can be secured to a wall (not shown). Each mounting plate is arranged to be oriented in first direction 48*a*. To alleviate the weight exerted upon on the assembly rods, the support bracket is preferably positioned in the center of the rod or rod assembly for support.

In the present embodiment, the first and second rods include first proximate end 28*a* and second proximate end 28*b*, respectively. Each proximate end is configured to slidingly engage one another. It should also be understood that the present invention assembly is not limited to the number or combination of rod assemblies or rods shown in the figures and that other numbers and combinations of rod assemblies and rods are included in the spirit and scope of the claimed invention. Specifically, a rod assembly can be formed from a single rod, a first rod and a second rod or more than two rods. For example, a multiple rod assembly may include two rods having the same length. Preferably, as illustrated in FIGS. 1-3, one rod has a greater length than the other does. Specifically, first rod 24 is 1 inch longer than rod 25; however, the length between the rods may be larger and is not limited to 1 inch. It should also be understood that the overall length of the rod assembly, i.e., the distance from the left bracket to the right bracket, can be adjusted to fit a specific size window by slidingly adjusting the length of the rods. Specifically, the length of the rod assembly can be increased or decreased by slidingly adjusting the first rod and the second rod and/or include an extension rod.

In some embodiments, left bracket 11 and right bracket 12, support bracket 40 and the rods can be made of any suitable cast metal. Specifically, left bracket 11 and right bracket 12, support bracket 40 and the rods are made out of aluminum. Aluminum is a preferred material because it is malleable and aluminum's low melting point makes it suitable for injection molding methods. Other metals having a low melting point may be used such as, for example, zinc, magnesium, or the like.

Figure 4:
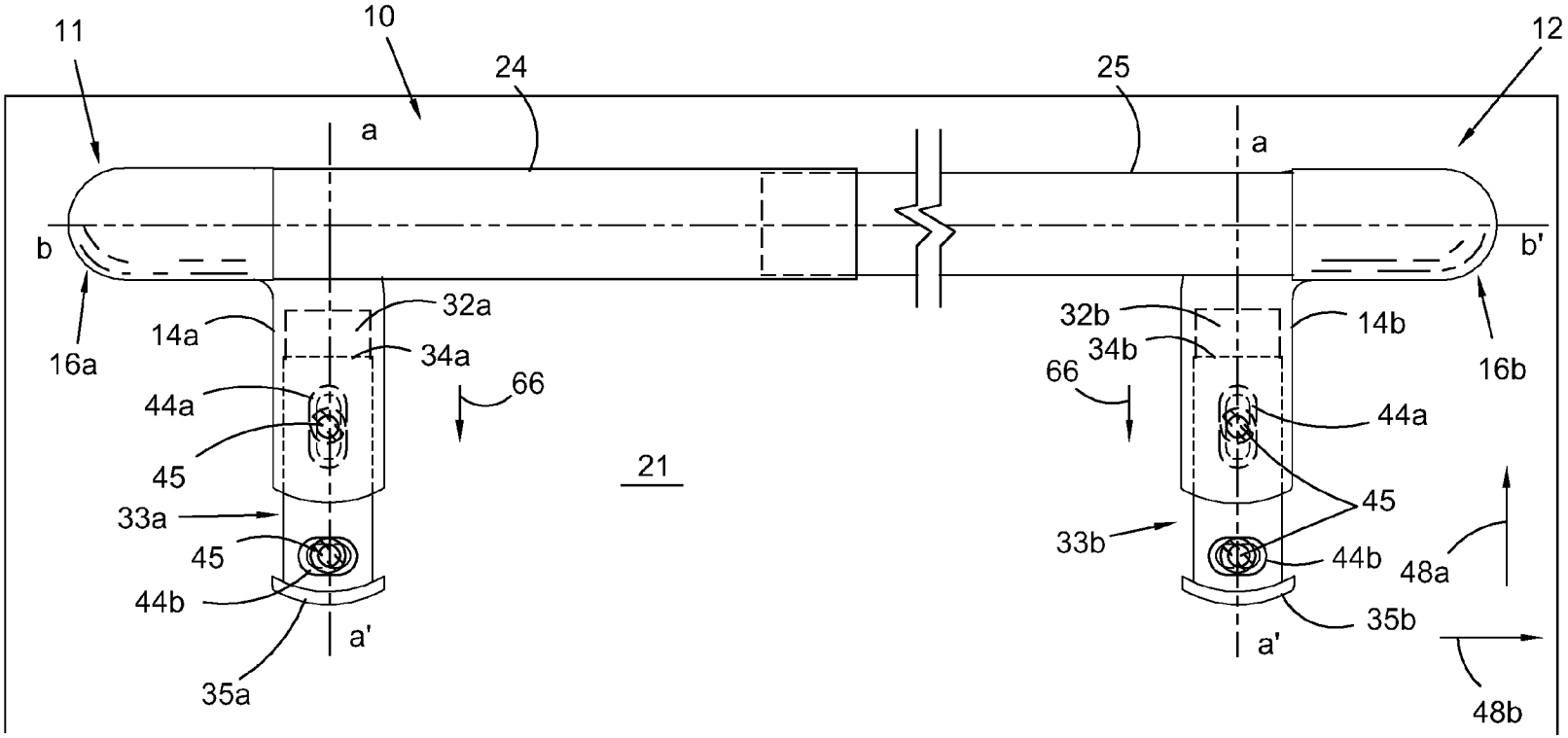
FIG. 4 is a front view of the present invention illustrating the drapery rod assembly partially engaging respective mounting plates.

FIG. 4 illustrates a front view of rod assembly 10 including left bracket 11 frictionally fastened to rod 24 and right bracket 12 frictionally fastened to rod 25. Rod 24 and rod 25 are slidingly engaged to one another and are collinear with longitudinal axis b-b'. To enable rod 25 to slidingly engage rod 24, the diameter of rod 25 is slightly smaller than the diameter of rod 24. Each mounting plate 33*a* and 33*b* is substantially collinearly arranged with longitudinal axis a-a' and is fixedly secured to wall 21 in first direction 48*a* by mounting screws 45, which pass through apertures 44*a-b*, respectively. Specifically, aperture 44*a* is oblong shaped along longitudinal axis a-a' and aperture 44*b* has an oblong shaped orthogonal to longitudinal axis a-a'. The configurations of the apertures enable the user to align the mounting plate when it is movably secured to a surface. FIG. 4 also illustrates wall portions 13*a-b* of the left and right brackets, slidingly engaging respective mounting plates 33*a* and 33*b*. Once the mounting plates are secured to a wall, each respective wall portion of the rod assembly can slidingly engage its respective mounting plate in a downward direction 66. The dotted line portion of left bracket 11, right bracket 12, mounting plates 33*a* and 33*b*, mounting holes 44*a*, and mounting screws 45 are for illustrative purposes to indicate the portion of hardware that is hidden from view with respect to the brackets' current downward position. Specifically, each mounting plate 33*a* and 33*b* is adapted to complementarily engage respective slot 32*a* and 32*b* and support respective brackets 11 and 12. Specifically, the top of slot 32*a* retainingly engages respective top end 34*a* of mounting plate 33*a* and the top of slot 32*b* retainingly engage respective top end 34*b* of mounting plate 33*b*. In addition, bottom end 35*a* of mounting plate 33*a* retainingly engages left bracket 11 and bottom end 35*b* of mounting plate 33*b* retainingly engages right bracket 12. Brackets 11 and 12 are adapted to fully engage each respective mounting plate 33 and position virtually all of the mounting plate and the securing hardware behind the surface of the brackets and are thus hidden from view. It should be appreciated that mounting plates 33 can be easily secured to a surface without obstruction from rod assembly accessories.

In FIGS. 1, 2 and 4, rod assembly 10 includes rods 24 and 25 that form a 'straight run.' That is, the rods are aligned along longitudinal axis b-b', thus the rods are substantially co-linear. Any means known in the art can be used to connect or align the rods, for example, an extension rod. It should be understood that the present invention assembly is not limited to a particular number of co-linear rods and that more than one set of co-linear rods may be used.

Figures 5A, 5B:
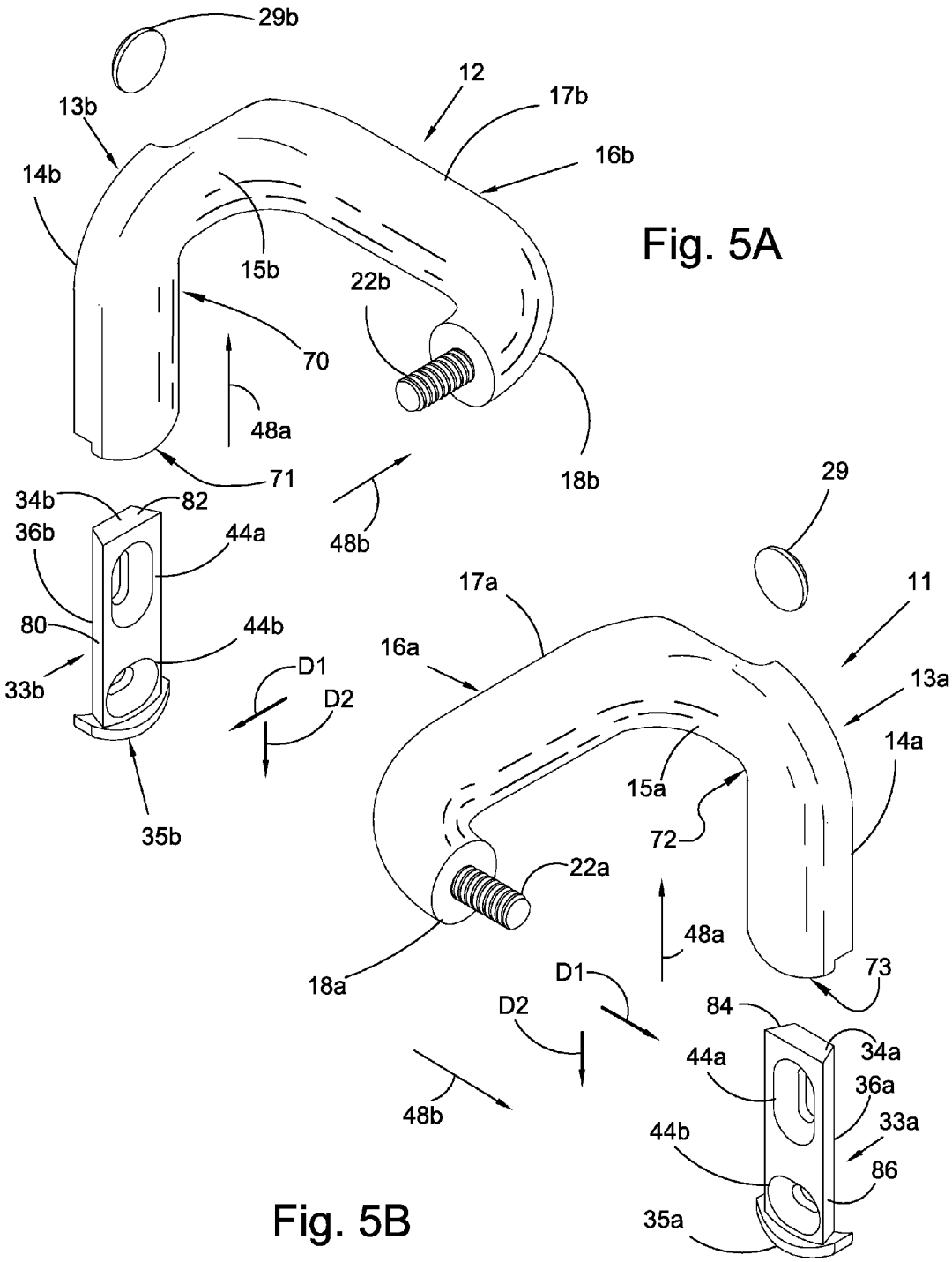
FIG. 5*a* is an exploded view of a right bracket of the present invention.
FIG. 5*b* is an exploded view of the left bracket of the present invention as shown in FIG. 2*b;*

FIG. 5*a* is an exploded view of the right bracket of the present invention. Right bracket 12 includes wall portion 13*b*, which is adapted to matingly engage a planar surface such as a wall. Right bracket 12 also includes extension portion 16*b* that is integrally formed with wall portion 13*b*. Wall portion 13*b* is seen to comprise first segment 14*b* and second segment 15*b*. Segment 14*b* includes top end 70 and bottom end 71. Segment 15*b* extends from top end 70. The second segment is in communication with and integrally extends from first segment 14*b*. This means that the second segment is undividedly connected to first segment 14*b* and diverted in a different direction from first segment 14*b*. Extension portion 16*b* is seen to comprise third segment 17*b* and fourth segment 18*b*; third segment 17*b* is in communication with and integrally extends from second segment 15*b*. This means that the third segment is undividedly connected to second segment 15*b* and diverted in a different direction from second segment 15*b*. Fourth segment 18*b* includes protrusion 22*b*, and is oriented opposite second direction 48*b*. Right bracket 12 also includes retaining member 29*b* and mounting plate 33*b* having top end 34*b*, bottom end 35*b*, insert portion 36*b* and mounting holes 44*a-b*. It should be understood that the first segment and the second segment of each bracket are integrally formed to comprise the wall portion. Similarly, the third segment and the fourth segment are integrally formed to comprise the extension member; however, each segment can be formed individually and become fixedly secured together. Similarly, the extension member and the wall portion of each bracket are integrally formed; however, the extension member and the wall portion can be formed individually and become fixedly secured together. Mounting plate 34*b* has a trapezoidal cross-section in direction D1 and includes surfaces 80 and 82 oriented in direction D2 orthogonal to Dl.

Similarly, FIG. 5*b* shows an exploded view of the left bracket of the present invention. Left bracket 11 includes wall portion 13*a*, which is adapted to matingly engage a planar surface such as a wall. Left bracket 11 also includes extension portion 16*a* that is integrally formed with wall portion 13*a*. Wall portion 13*a* is seen to comprise first segment 14*a*and second segment 15*a*. Segment 14*a* includes top end 72, and bottom end 73. Segment 15*a*extends from top end 72. The second segment is in communication with and integrally extends from first segment 14*a*. This means that the second segment is undividedly connected to first segment 14*a* and diverted in a different direction from first segment 14*a*. Extension portion 16*a*is seen to comprise third segment 17*a* and fourth segment 18*a*; third segment 17*a* is in communication with and integrally extends from second segment 15*a*. This means that the third segment is undividedly connected to second segment 15*a* and diverted in a different direction from second segment 15*a*. Fourth segment 18*a* includes protrusion 22*a*, and is oriented in second direction 48*b*. Left bracket 11 also includes retaining member 29*a* and mounting plate 33*a*having top end 34*a*, bottom end 35*a*, insert portion 36*a* and mounting holes 44*a-b*. In some embodiments, as shown in FIGS. 4*a* and 4*b*, the second segment is parallel to the fourth segment, the second segment is orthogonal to the third segment, and the third segment is orthogonal to the fourth segment. Furthermore, in the present embodiment, the left and right brackets are comprised of second and third segments that are arranged to form a right angle or a 90° angle, and the third, and the fourth segments are arranged to form a right angle or a 90° angle. It should be understood that the total angle amount is equal to 180° . It should be appreciated that the particular angle of the segments may be modified without departing from the scope of the appended claims. In some embodiments, for example, the extension portion may be comprised of a second segment and a third segment forming an angle between them equal to or greater than 90° , and the third segment and a fourth segment forms an angle between them equal to or less than 90° . Mounting plate 34*a* has a trapezoidal cross-section in direction D1 and includes surfaces 84 and 86 oriented in direction D2.

Figure 6:
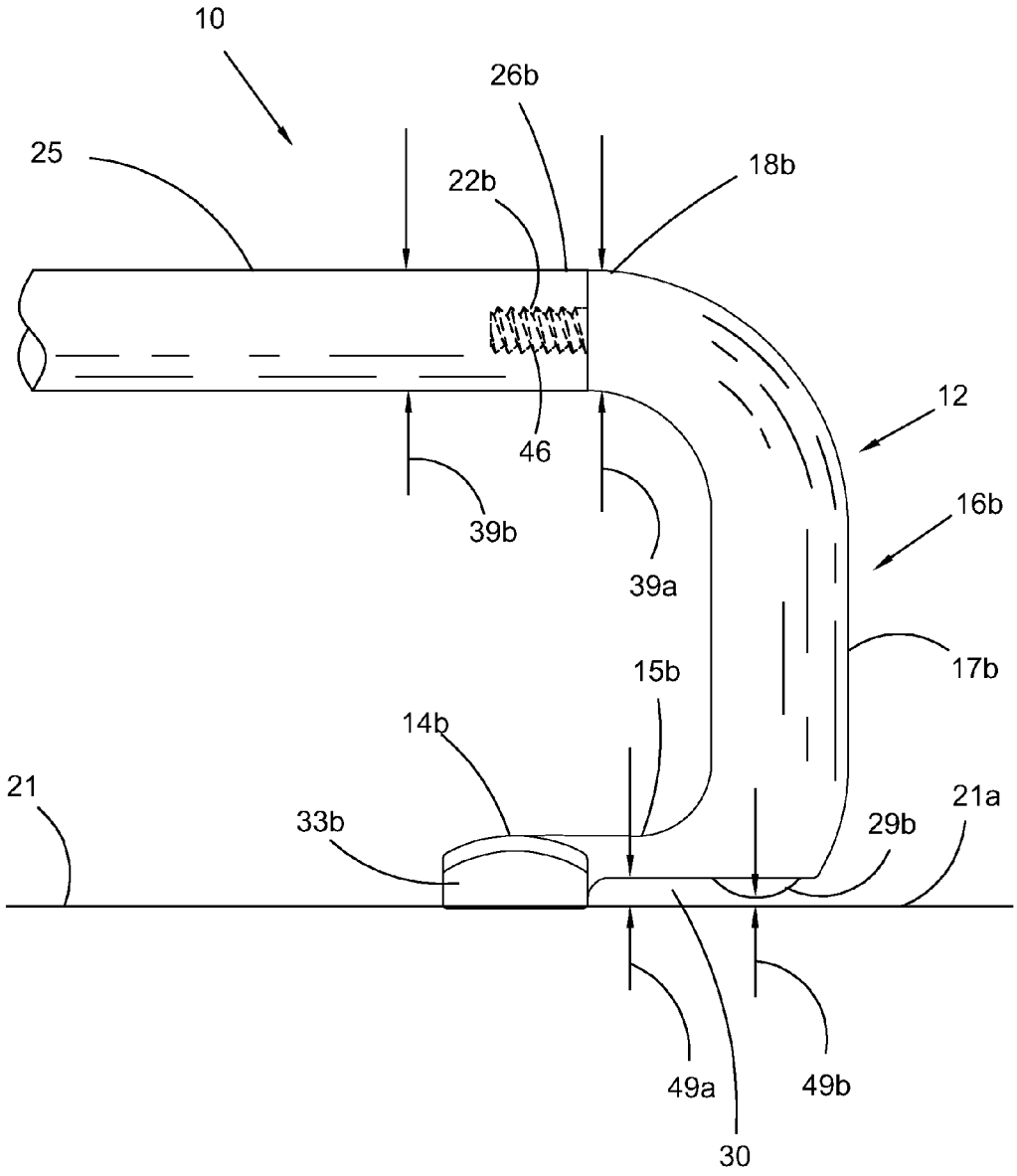
FIG. 6 is a bottom view of a rod secured to the right bracket of the present invention.

FIG. 6 illustrates a fragment of second rod 25 threadedly secured to right bracket 12. Second segment 15*b* forms recess 30 when mated with plane of planar surface 21*a*. Fabric retaining area or recess 30 has first height 49*a*, which is arranged to receive a portion of fabric between a planar surface, such as a wall and second segment 15*b* of bracket 12. Preferably, first height 49*a* can be in the range of about 3 mm to about 5.5 mm. Specifically, first height 49*a* is 4 mm. Retaining member 29*b* extends into recess 30 forming a gap between plane of planar surface 21*a* and the retaining member. The gap formed between plane of planar surface 21*a* and the retaining member has second height 49*b*, which is preferably less than first height 49*a*. Preferably, second height 49*b* can be in the range of about 2 mm to about 4.5 mm. Specifically, second height 49*b* is 3 mm. It should be understood that the height of recess 30 and the height of retaining member 29 could be adjusted to receive and hold various sized portions of fabric within the recess.

FIG. 6 also shows a bottom view of right bracket 12 having protrusion 22*b* with external threads 46 on fourth segment

18*b*. In this embodiment of the present invention, distal end 26*b* of rod 25 includes complementary internal threads (not shown) for receiving protrusion 22*b* with external threads 46, thereby enabling a removably fastenable screwed engagement between bracket 12 and rod 25. In the present embodiment, fourth segment 18*b* has diameter 39*a* of about 16 mm. Preferably, diameter 39*a* of fourth segment 18*b* is substantially equal to diameter 39*b* of rod 25. However, the rod or rods and the respective attaching ends are not limited to the size as shown in the figures or described in the specification. It should be understood that protrusion 22*b* can be integrally formed within fourth segment 18*b* or protrusion 22*b* and the fourth segment can be formed individually and become fixedly secured together. It should also be understood that rod 25 and fourth segment 18*b* are generally cylindrical in shape. However, the rod or rods and the respective connecting segment of each bracket are not limited to the shape as shown in the figures and that other shapes are included in the spirit and scope of the claimed invention. For example, the shape of the rod and the fourth segment may be rectangular, oval, polygonal, or any combination thereof.

Figure 7A:
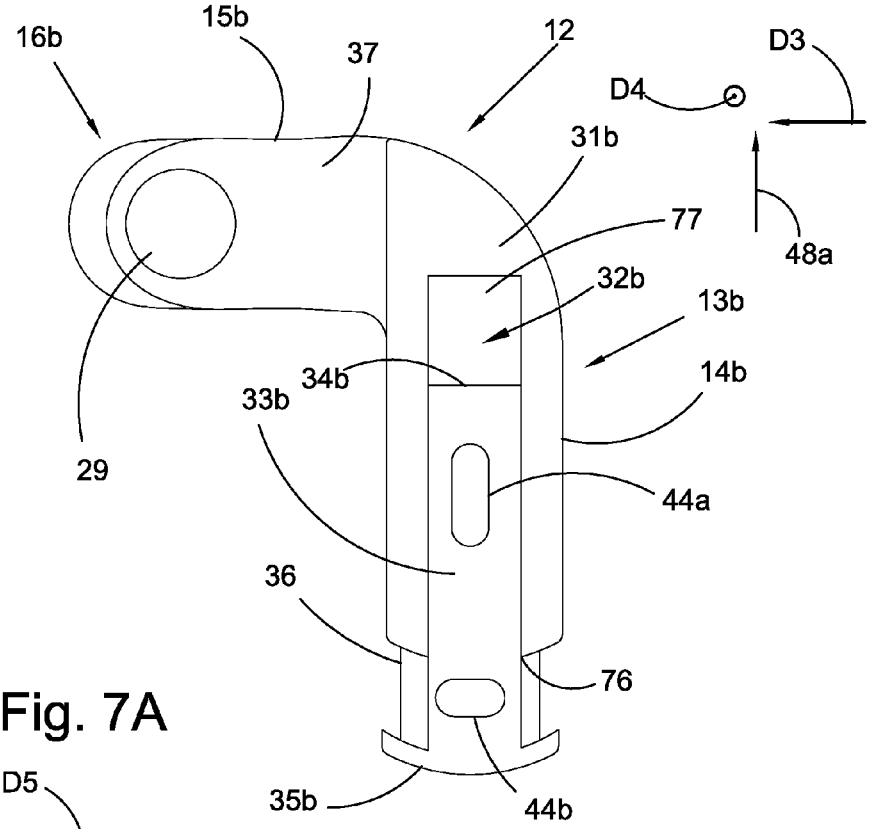
FIG. 7*a* is a rear view of the right bracket of the present invention.

FIG. 7*a* is a rear view of right bracket 12 including extension portion 16*b* and wall portion 13*b* having planar back surface 31*b*. Back surface 31*b* includes slot 32*b*, which is operatively arranged to receive mounting plate 33*b*. Specifically, right bracket 12 slidingly engages mounting plate 33*b* in a manner that positions virtually all of the mounting plate behind the surface of each of the assembly brackets. FIG. 7*a* also illustrates insert portion 36*b* partially engaged within slot 32*b*. Segment 15*b* extends from top end 70 of segment 14*b* in direction D3 and includes planar surface 37*b* non-coplanar with surface 31*b*. Surface 37*b* is offset from surface 31*b* in direction D4 (into the page in FIG. 7A) orthogonal to direction D3. Surfaces 31*b* and 37*b* are wholly misaligned in direction D4 as shown in FIG. 7A.

Figure 7B:
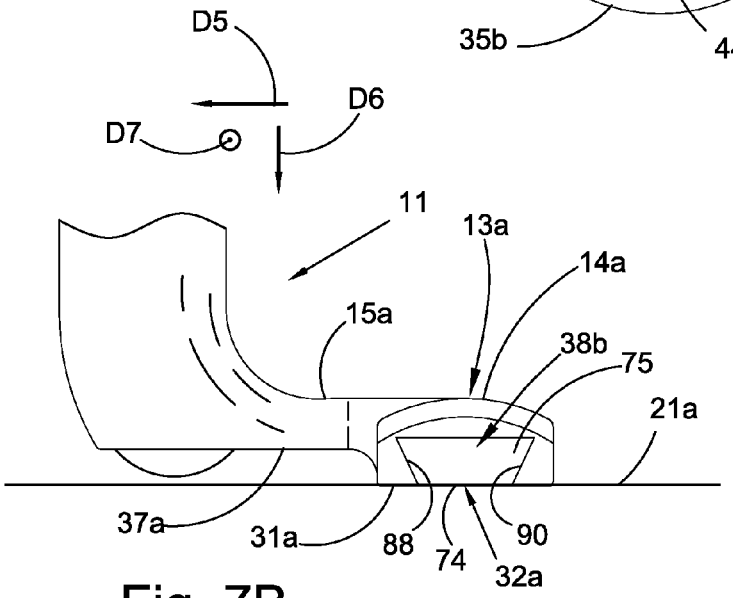
FIG. 7*b* is a partial bottom view of the left bracket of the present invention.
Figure 7C:
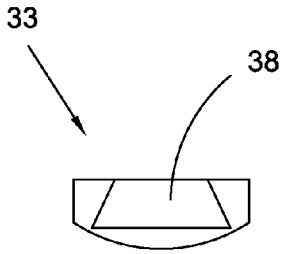
FIG. 7*c* is a top view of a mounting plate of the present invention.

FIG. 7*b* illustrates a detail view of the left bracket of the present invention further illustrating left bracket 11 with wall portion 13*a* having planar back surface 31*a*. Wall portion 13*a* has back surface 31*a*, and second segment 16*b* has recessed planar surface 37*a*. Back surface 31*a* and recessed surface 37*a* are non-coplanar. Recess 30 is formed when wall portion 13*a* is mounted to planar surface such as a wall. Back surface 31*a* includes slot 32*a*, which is operatively arranged to receive mounting plate 33, which is illustrated in FIG. 7*c*. Slot 32*a* is wholly enclosed by material forming wall portion 13*a* with the exception of opening 74 in back surface 31*a* and opening 75 in bottom end 73. Opening 75 can be understood by viewing opening 76 in slot 32*b* in FIG. 7A. Slot 32*b* is wholly enclosed by material forming wall portion 13*b* with the exception of opening 77 in back surface 31*b* and opening 76 in bottom end 71. Opening 77 can be understood by viewing opening 74 in slot 32*a* in FIG. 7B. Slot 32*a* has essentially second trapezoidal cross-section 38*b* configuration that opens on one side. Specifically, insert portion 36 of mounting plate 33*a* has first trapezoidal cross-section 38*a*. Preferably, slot 32 and mounting plate 33 are complementarily shaped. It should be understood that the mounting plate is made to universally fit all of the brackets. This means, the shape of the cross section of the mounting plate is adapted to complementarily engage the slot of any bracket in the assembly. It should also be understood that slot 32 and mounting plate 33 are not limited to the shape or configuration as shown in the figures and that other shapes and configurations are included in the spirit and scope of the claimed invention, such as, for example, the mounting plate and slot may have a circular or a polygonal cross-section. Alternatively, the mounting plate and slot may include a flange and slot arrangement or other suitable configurations. Segment 15*a*extends from top end 72 of segment 14*a* in direction D5. Surface 37*b* is offset from surface 31*b*in direction D6 orthogonal to direction D5. Surfaces 31*a* and 37*a* are wholly misaligned in direction D6 as shown in FIG. 7B. When portion 13*a* is engaged with mounting plate 33*a* such that mounting plate 33*a* is at least partially located in slot 32*a*, surface 31*a* faces mounting plate 33*a*. When portion 13*b* is engaged with mounting plate 33*b* such that mounting plate 33*b* is at least partially located in slot 32*b*, surface 31*b* faces mounting plate 33*b*. Slot 32*a* has a trapezoidal cross-section in direction D5 and includes surfaces 88 and 90 oriented in direction D7 (into or out of the page) orthogonal to D5. The discussion regarding the cross-section and surfaces of slot 32*a* is applicable to slot 32*b*.

Figure 8A:
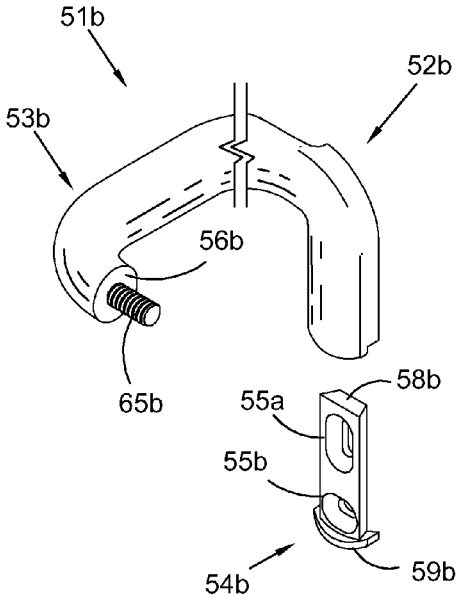
FIG. 8*a* is an exploded view of a left bracket of the present invention.
Figure 8B:
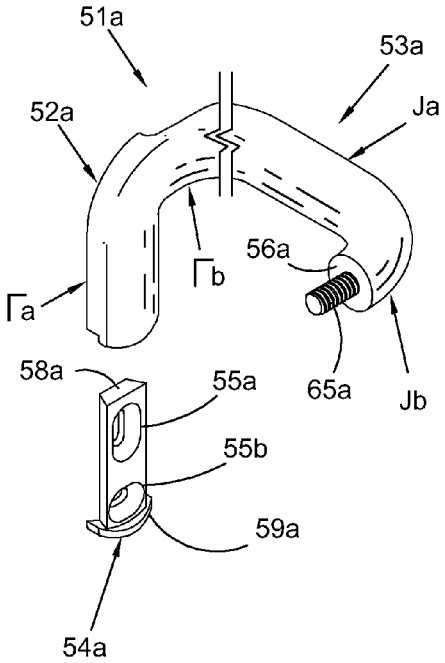
FIG. 8*b* is an exploded view of a right bracket of the present invention.

The present invention may comprise right bracket 51*a* having a substantially gamma shaped wall portion 52*a*, as illustrated in FIG. 8*b*. Specifically, the wall portion is in the shape of the capital Greek letter gamma. The preferred gamma shaped configuration of the wall portion is advantageous in that the longer, vertical segment Γa of the gamma is arranged to receive the mounting plate. The shorter, horizontal leg Γb of the gamma perpendicularly extends from vertical leg Γa to form a recess when the wall portion is matingly engaged to a substantially planar surface. Preferably, horizontal leg Γb extends outward and perpendicularly away from the rod assembly. This configuration enables a recess to form between a surface and partially behind each end bracket, and allows a portion of drapery fabric to be wrapped around the brackets and retained within the respective recess, virtually concealing the rod assembly from view. Right bracket 51*a* also includes a substantially J-shaped extension portion 53*a*. The preferred J-shaped configuration of the extension portion is advantageous in that the longer, extension segment Ja extends outwardly and away from gamma shaped wall portion 52*a*, and curved segment Jb terminates in rod attachment end 56*a* perpendicularly arranged with respect to the mounting plate and in parallel spaced apart relation to the substantially planar surface. Rod attachment end 56*a* includes rod attachment means 65*a*. The right bracket also includes a mounting plate operatively arranged to be mounted to the substantially planar surface. The right bracket has a slot that slidingly engages mounting plate 54*a*. The mounting plate includes top end 58*a*, bottom end 59*a*, and mounting holes 55*a-b*. The mounting plate is operatively arranged to complementarily engage the slot and hold the wall portion.

Preferably, the left bracket is an enantiomer of the right bracket. An enantiomer is defined as one of two objects that are mirror images of each other but the objects are non-superposable or not identical. By this we mean that the two objects are the same, but opposite. For example, as illustrated in FIG. 8*a*, left bracket 51*b* is a mirror image of right bracket 51*a*. The left bracket includes wall portion 52*b* that is shaped as an enantiomer of the letter gamma. Extension portion 53*b* is shaped as an enantiomer of the letter "J". The extension portion terminates in rod attachment end 56*b*, which is arranged perpendicularly with respect to the mounting plate and in parallel spaced apart relation to the substantially planar surface. Rod attachment end 56*b* includes rod attachment means 65*b*. The left bracket has a slot that slidingly engages mounting plate 54*b*. The mounting plate includes top end 58*b*, bottom end 59*b*, and mounting holes 55*a-b*. The mounting plate is operatively arranged to complementarily engage the slot and hold the wall portion.

Figure 8C:
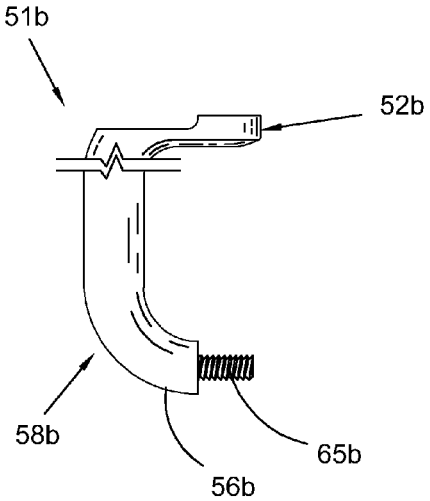
FIG. 8*c* is a top view of the left bracket of the present invention.
Figure 8D:
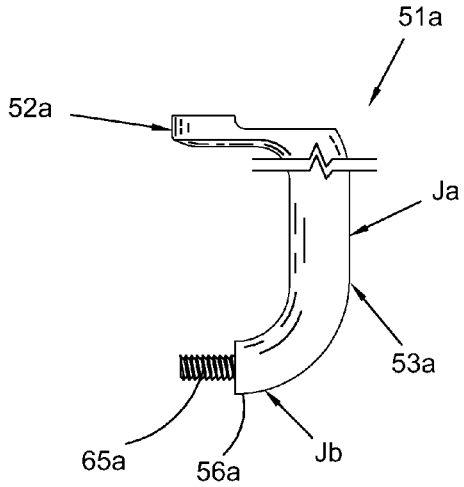
FIG. 8*d* is a top view of the right bracket of the present invention.

FIG. 8*c* is a top view of left bracket 51*b*, which is an enantiomer of right bracket 51*a* shown in FIG. 8*d*. It should be appreciated that the mirror configuration of the extension portions of each bracket is advantageous in that rod attachment end 56*b* of left bracket 51*b* and rod attachment end 56*a* of right bracket 51*a* are collinear and are in parallel spaced apart relation to the substantially planar surface. This arrangement enables a rod or rod assembly to be supported and positioned substantially parallel with the substantially planar surface. It should be understood that the wall portions and the extension portions of the right and left brackets are not limited to the shape or configuration as shown in the figures. It should be noted that other shapes and configurations are included in the spirit and scope of the claimed invention. For example, the wall portion of the right bracket can be shaped like an upside down capital letter "L". The extension portion of the left bracket can be shaped like a capital letter "L", the wall portion of either bracket can be the shape of a capital latter "I", with an extension portion having a substantially U shape or any other suitable combination of shapes.

Figure 9:
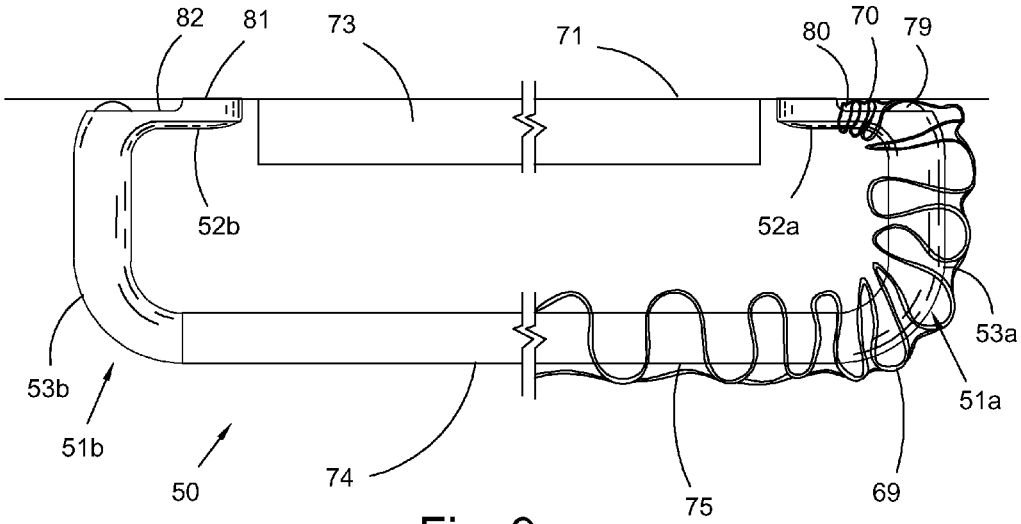
FIG. 9 is a top view of the present invention illustrating drapes wrapped about the right bracket.

FIG. 9 shows a top view of the present invention illustrating drapery rod assembly 50 positioned over window 73 and mounted onto wall 71. The assembly is shown to have drapes 69 supported upon second rod 75 and wrapped about or around right bracket 51*a*. First rod 74 is linearly aligned with second rod 75 and the rod assembly is in parallel spaced apart relation to the substantially planar surface. The right bracket includes wall portion 52*a* having retaining member 79. Each wall portion has first surface 81, and second surface 82. First surface 81 and second surface 82 are non-coplanar; this configuration forms recess 80 when wall portion 52*a* is mounted to a planar surface such as a wall 21. Recess 80 is adapted to receive portion of fabric 70, and retaining member 79 is operatively arranged to hold portion of fabric 70 within the recess. This configuration provides an advantageous aspect to the present invention enabling a portion of the fabric to wrap about the left and right brackets virtually concealing the brackets and assembly from view. Retaining member 79 can be made of any type elastomeric material such as, for example, silicone rubber. The silicone material in combination with the gap formed between retaining member 79 and the wall retains portion of fabric 70 within recess 80. It should be appreciated that the retaining member helps to retain a portion of the fabric within the retaining area; however, the retaining member is not absolutely necessary.

Figure 10A:
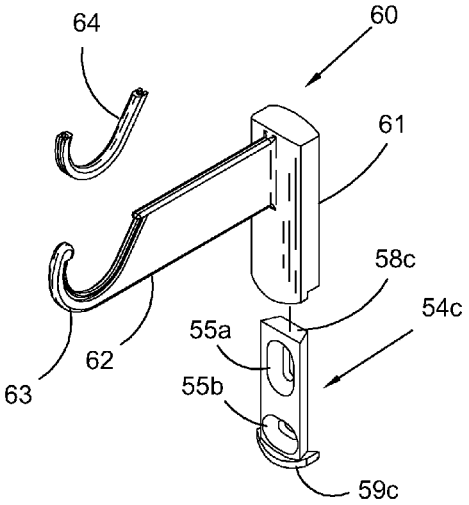
FIG. 10*a* is an exploded view of a support bracket of the present invention.

FIG. 10*a* is an exploded view of support bracket 60 shown in FIG. 3. In one embodiment, the drapery rod assembly has at least one support bracket, which is used to support rod assemblies. Support bracket 60 include wall portion 61, horizontal segment 62 having rod receiving portion 63. The support bracket includes mounting plate 54*c* having top end 58*c*, bottom end 59*c*, and mounting holes 55*a-b*. The mounting plate is operatively arranged to complementarily engage the slot and hold the wall portion. It should be understood that any configuration known in the art can be used for the support brackets. It also should be understood that the assembly is not limited to a particular number of support brackets. In some embodiments, receiving portion 63 may include liner 64; however, the liner it not absolutely necessary.

Figure 10B:
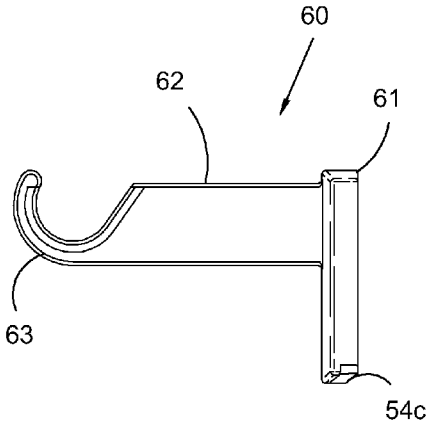
FIG. 10*b* is a side view of the support bracket of the present invention; and, FIG. 11 is an exploded view of a second embodiment of the present invention.

FIG. 10*b* is a side view of the support bracket of the present invention.

Figure 11:
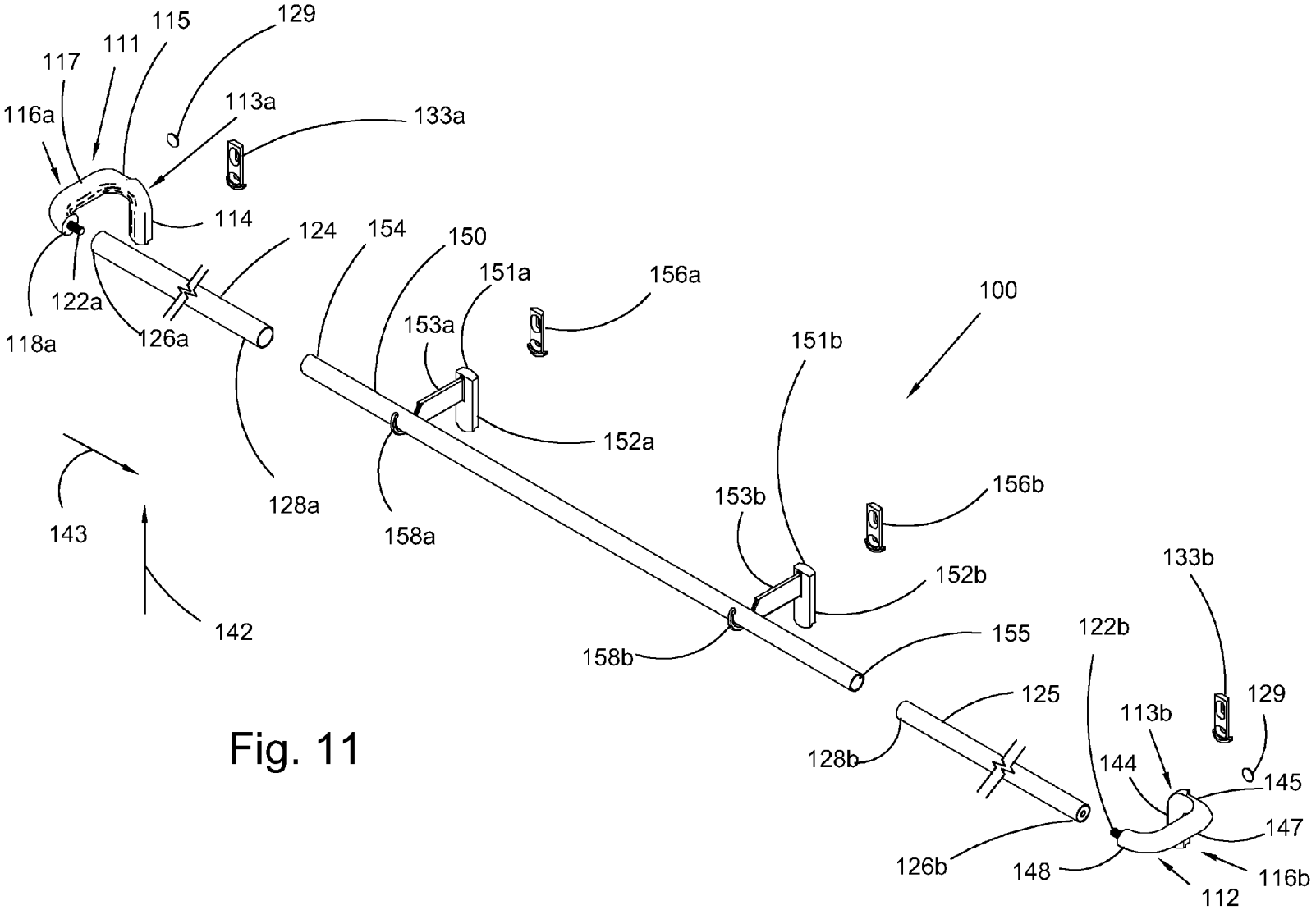

FIG. 11 is an exploded front perspective view of a second embodiment of the present invention. In some embodiments, rod assembly 100 includes left bracket 111, right bracket 112, first rod 124, and second rod 125. Left bracket 111 is seen to comprise first wall portion 113*a*, including first segment 114 and second segment 115; first extension portion 116*a*, which is integrally formed with first wall portion 113*a*, includes third segment 117 and fourth segment 118. First wall portion 113*a* is adapted to slidingly engage mounting plate 133*a*, which is oriented in first direction 142. Similarly, right bracket 112 is seen to comprise second wall portion 113*b*, including fifth segment 144 and sixth segment 145; extension portion 116*b*, which is integrally formed with second wall portion 113*b*, includes seventh segment 147 and eighth segment 148. Fourth segment 118 is oriented in second direction 143 and eighth segment 148 is oriented opposite second direction 143. Specifically, fourth segment 118 and eighth segment 148 are collinearly aligned and oppositely arranged. Second wall portion 113*b* is adapted to slidingly engage mounting plate 133*b*, which is oriented in first direction 142. In some embodiments, first extension portion 116*a* of left bracket 111 and second extension portion 116*b* of right bracket 111 may be U-shaped. In some embodiments, each wall portion 113*a-b* is adjacently aligned with respective extension portion 116*a-b* of brackets 111 and 112, respectively. In some embodiments, each bracket may include retainer member 129.

In one embodiment, left bracket 111 includes protrusion 122*a* on respective fourth segment 118, and rod 124 includes a complementary opening for protrusion at respective distal end 126*a*. Specifically, protrusion 122*a* of fourth segment 118 is threadedly secured to first distal end 126*a* of first rod 124. Similarly, right bracket 112 includes protrusion 122*b* on respective eighth segment 148, and rod 125 includes a complementary opening for protrusion at respective distal end 126*b*. Protrusion 122*b* of eighth segment 148 is threadedly secured to second distal end 126*b* of second rod 125.

Rod assembly 100 includes extension rod 150 including first open end 154 and second open end 155. Each of the receiving ends of extension rod 150 is arranged to engage first proximate end 128*a* and second proximate end 128*b* of first rod 124 and second rod 125, respectively. Specifically, first open end 154 slidingly engages first proximate end 128*a* of rod 124, and second open end 155 slidingly engages second proximate end 128*b* of rod 125. Rod assembly 100 further comprises support brackets 151*a* and 151*b*. In some embodiments, first support bracket 151*a* includes wall portion 152*a*, and horizontal segment 153*a* having rod receiving portion 158*a*. Similarly, second support bracket 151*b* includes wall portion 152*b*, and horizontal segment 153*b* having rod receiving portion 158*b*. Each of the rod receiving portions is complementary in shape to receive and support the third rod. Each support bracket includes mounting plate 156*a-b*, which can be secured to a wall (not shown).

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A drapery rod assembly adapted to be secured to a substantially planar surface comprising:

a first bracket;

a second bracket comprising:

a mounting plate, operatively arranged to be mounted to said substantially planar surface;

a substantially gamma shaped wall portion, separate from the mounting plate, having:

a first segment having a top end, a first planar surface facing a first direction, and a slot in the first planar surface; and a second segment extending from the top end of the first segment in a second direction orthogonal to the first direction and including a second planar surface facing the first direction, non-coplanar with the first planar surface, offset from the first planar surface in the first direction, and wholly misaligned with the first planar surface in the second direction, said first mounting plate is operatively arranged to complementarily engage said slot and hold said wall portion such that the second planar surface is offset from the planar surface in the second direction;

a substantially J-shaped extension portion, said extension portion integrally extends outward from said wall portion and terminates in a rod attachment end arranged perpendicularly with respect to said mounting plate and in parallel spaced apart relation to said substantially planar surface, wherein said left bracket is an enantiomer of said right bracket; and, at least one rod, wherein a first rod and a second rod from said at least one rod comprises a proximate end and a distal end, said distal end of said first rod is releasably engaged with said left bracket, said distal end of said second rod is releasably engaged with said rod attachment end of said right bracket, said proximate end of said first rod is arranged to slidingly engage said proximate end of said second rod.

2. The drapery rod assembly recited in claim 1, wherein a recess is formed between said second planar surface and a plane of said substantially planar surface when said first planar surface is matingly engaged to said substantially planar surface, said recess has a first height with respect to said plane of said substantially planar surface.

3. The drapery rod assembly recited in claim 2, further comprising a retaining member extending from the second planar surface in a third direction opposite the second direction and having a second height with respect to the second planar surface less than said first height.

4. The drapery rod assembly recited in claim 3, wherein said retainer member is made of an elastomeric material.

5. The drapery rod assembly recited in claim 1, wherein said drapery rod assembly includes at least one support bracket, said support bracket includes a third mounting plate, which is operatively arranged to be mounted to said substantially planar surface, a horizontal segment and a third wall portion having a slot, said third mounting plate is operatively arranged to complementarily engage said slot and hold said third wall portion, said horizontal segment has a rod-receiving portion, which is operatively arranged to support said first rod and said second rod.

6. The drapery rod assembly recited in claim 1, wherein said first mounting plate has a first cross-section, and said slot has a second cross-section, wherein said first cross-section is complementary to said second cross-section.

7. A drapery rod assembly adapted to be secured to a substantially planar surface, comprising:

a left bracket, said left bracket comprising:

a first mounting plate:

having a first trapezoidal cross-section in a first direction;

including first and second surfaces oriented in a second direction orthogonal to the first direction; and operatively arranged to be mounted to said substantially planar surface;

a first wall portion, separate from the first mounting plate, including:

a first segment including a first slot:

with a second trapezoidal cross-section in a third direction;

third and fourth surfaces oriented in a fourth direction orthogonal to the third direction; and a first opening facing in the fourth direction; and a second segment, said second segment is in communication with and extends from said first segment in the third direction, said wall portion is arranged to engage the first mounting plate such that:

the mounting plate is at least partially located within the slot;

the first and third surfaces are in contact; and, the second and fourth surfaces are in contact;

a first extension portion including:

a third segment, and a fourth segment oriented in a second direction, said third segment is in communication with and extends outward from said second segment, said fourth segment is arranged perpendicularly with respect to said mounting plate and in parallel spaced apart relation to said substantially planar surface;

a right bracket, said right bracket comprising:

a second mounting plate having a third trapezoidal cross-section, said second mounting plate oriented in a first direction, and operatively arranged to be mounted to said substantially planar surface;

a second wall portion including:

a fifth segment and a sixth segment, said fifth segment includes a slot and a fourth trapezoidal cross-section, said sixth segment is in communication with and integrally extends from said fifth segment, said third trapezoidal cross-section is operatively arranged to complementarily engage said fourth trapezoidal cross-section and hold said fifth segment;

a second extension portion including:

a seventh segment, and a eighth segment, said seventh segment is in communication with and integrally extends from said sixth segment, said eighth segment is arranged perpendicularly with respect to said mounting plate and in parallel spaced apart relation to said substantially planar surface, and wherein said eighth segment is oriented opposite said second direction and collinearly aligned with said fourth segment; and, at least one rod, wherein a first rod and a second rod from said at least one rod comprises a proximate end and a distal end, said distal end of said first rod is releasably engaged with said fourth segment, said distal end of said second rod is releasably engaged with said eighth segment, said proximate end of said first rod is arranged to slidingly engage said proximate end of said second rod.

8. The drapery rod assembly recited in claim 7, wherein said left bracket is an enantiomer of said right bracket.

9. The drapery rod assembly recited in claim 7, wherein:

every rod in the drapery rod assembly is aligned with one only single longitudinal axis; and said rod assembly comprises an extension rod including a first open end and a second open end, said first open end is arranged to slidingly engage said proximate end of said first rod, and said second open end is arranged to slidingly engage said proximate end of said second rod.

10. The drapery rod assembly recited in claim 7, wherein said rod assembly comprises at least one support bracket having a third mounting plate oriented in a first direction, said third mounting plate is operatively arranged to be mounted to said substantially planar surface, a third wall portion having a slot, and a horizontal segment, said third mounting plate is operatively arranged to complementarily engage said slot and hold said third wall portion, said horizontal segment includes a rod receiving portion which is operatively arranged to engage and support said at least one rod.

11. The drapery rod assembly recited in claim 7, wherein said fourth segment includes a first protrusion, and said eighth segment includes a second protrusion, in which each said protrusion is externally threaded.

12. The drapery rod assembly recited in claim 11, wherein the distal end of the first rod is threadedly secured to the fourth segment of the left bracket, and the distal end of the second rod is threadedly secure to the eighth segment of the right bracket.

13. The drapery rod assembly recited in claim 7, wherein said second segment is parallel to said fourth segment, said second segment is orthogonal to said third segment, and said third segment is orthogonal to said fourth segment.

14. The drapery rod assembly recited in claim 7, wherein said sixth segment is parallel to said eighth segment, said sixth segment is orthogonal to said seventh segment, and said seventh segment is orthogonal to said eighth segment.

* * * * *